US010011978B1

(12) United States Patent
Mahon

(10) Patent No.: US 10,011,978 B1
(45) Date of Patent: Jul. 3, 2018

(54) DEAD-END WATER-LINE FLUSHING SYSTEM

(71) Applicant: Robert A Mahon, Watauga, TX (US)

(72) Inventor: Robert A Mahon, Watauga, TX (US)

( * ) Notice: Subject to any disclaimer, the term of this patent is extended or adjusted under 35 U.S.C. 154(b) by 0 days.

(21) Appl. No.: 15/220,802

(22) Filed: Jul. 27, 2016

Related U.S. Application Data

(60) Provisional application No. 62/197,623, filed on Jul. 28, 2015.

(51) Int. Cl.

| | |
|---|---|
| ***E03B 7/08*** | (2006.01) |
| ***E03B 7/02*** | (2006.01) |
| ***E03B 7/07*** | (2006.01) |
| *F16K 31/06* | (2006.01) |

(52) U.S. Cl.
CPC ..... *E03B 7/08* (2013.01); *E03B 7/02* (2013.01); *E03B 7/071* (2013.01); *E03B 7/074* (2013.01); *F16K 31/06* (2013.01); *Y10T 137/86389* (2015.04)

(58) Field of Classification Search
CPC ... E03B 7/08; E03B 7/02; E03B 7/071; Y10T 137/86389
USPC ..... 137/238, 613
See application file for complete search history.

(56) References Cited

U.S. PATENT DOCUMENTS

| | | | | |
|---|---|---|---|---|
| 3,320,965 A * | 5/1967 | Morgan | E03F 7/10 137/517 |
| 6,116,525 A * | 9/2000 | Grimes | E03B 9/18 239/172 |
| 6,119,707 A * | 9/2000 | Jordan | E04H 4/1645 134/167 R |
| 2002/0043490 A1* | 4/2002 | Newman | E03B 7/006 210/94 |
| 2007/0075162 A1* | 4/2007 | McKeague | E03B 7/006 239/104 |

* cited by examiner

*Primary Examiner* — Kevin Lee
(74) *Attorney, Agent, or Firm* — Kenneth L. Tolar

(57) ABSTRACT

A system for automatically flushing a dead-end line in a municipal water artery includes a bleeder tube coupled with the dead-end line having a solenoid valve that opens and closes according to a command from a controller. A drain line connected to the solenoid valve extends to a pair of perforated caps installed on a street curb for delivering water from the dead-end line to a municipal drainage system at preprogrammed intervals.

11 Claims, 2 Drawing Sheets

DEAD-END WATER-LINE FLUSHING SYSTEM

CROSS REFERENCE TO RELATED APPLICATIONS

This application is entitled to the benefit of provisional patent application No. 62/197,623 filed on Jul. 28, 2015, the specification of which is incorporated herein by reference.

BACKGROUND OF THE INVENTION

The present invention relates to a system for flushing dead-end lines in municipal water systems to minimize stagnation.

DESCRIPTION OF THE PRIOR ART

Most municipal water systems include dead-end lines where a given artery terminates. The stagnant water within these lines often generates a dangerous level of microbiological organisms that can inadvertently enter the water supply. Likewise, water-treatment chemicals can eventually degrade into hazardous compounds that threaten the water supply. In order to minimize such problems, a maintenance crew will sometimes manually flush dead-end lines though the practice is laborious, costly, time consuming and burdensome. Although a few portable, automated flushing systems exist, they are difficult to erect, and they expose expensive equipment to vandalism or inadvertent damage.

Accordingly, there is currently a need for a means of efficiently flushing a dead-end water line. The present invention addresses this need by providing an automated flushing system that periodically diverts water from the dead-end line to a municipal drainage system.

SUMMARY OF THE INVENTION

A flushing system comprises a bleeder tube coupled with a dead-end water line having a solenoid valve that opens and closes according to a command from a controller. A drain line connected to the solenoid valve extends to a pair of perforated caps installed on a street curb for delivering water from the dead-end line to a municipal drainage system at preprogrammed intervals.

It is therefore an object of the present invention to provide a flushing system for dead-end water lines.

It is therefore another object of the present invention to provide a flushing system for dead-end water lines that can be programmed to operate at desired intervals and for desired durations.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
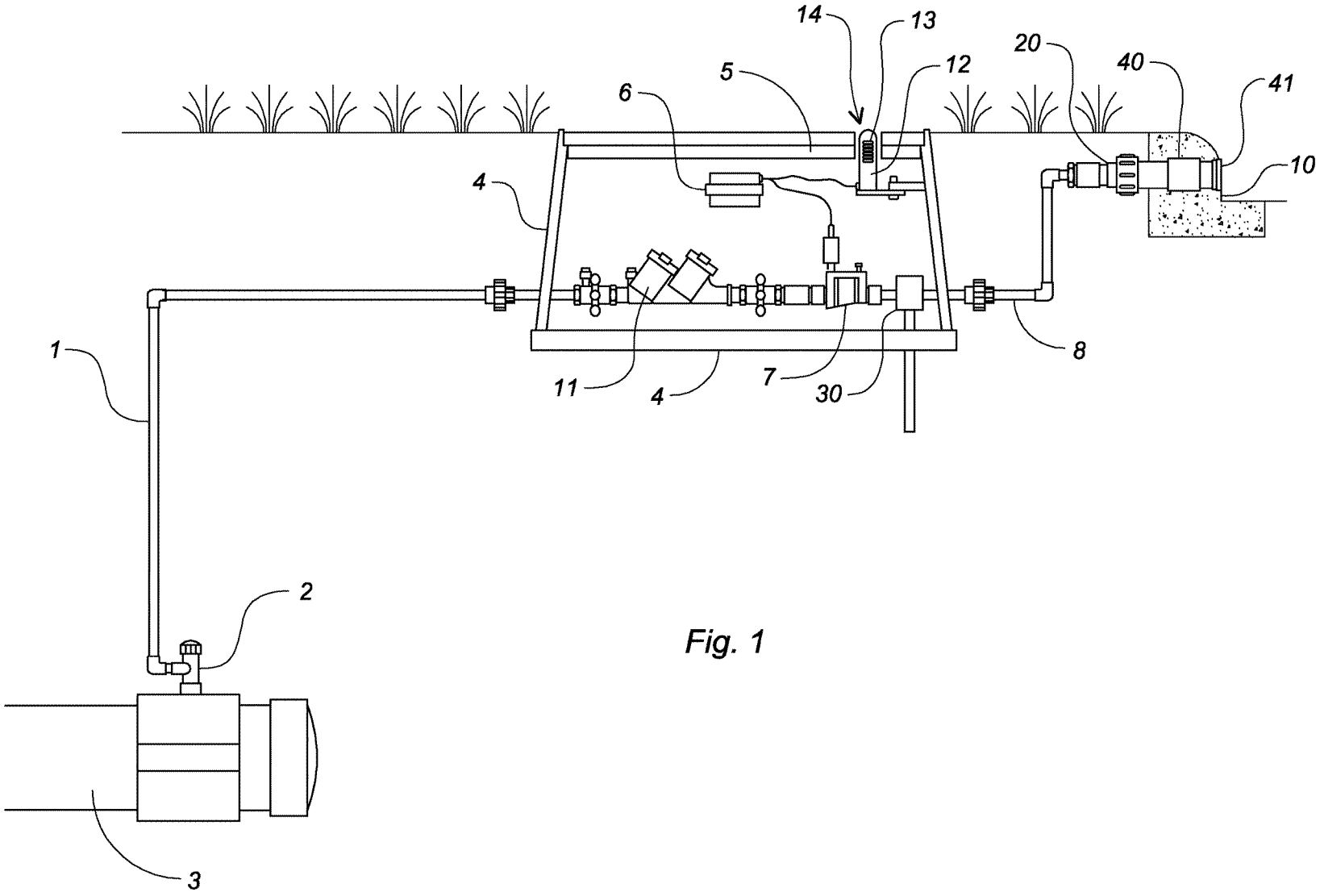
FIG. 1 depicts the flushing system according to the present invention properly connected to a dead-end water line.
Figure 2:
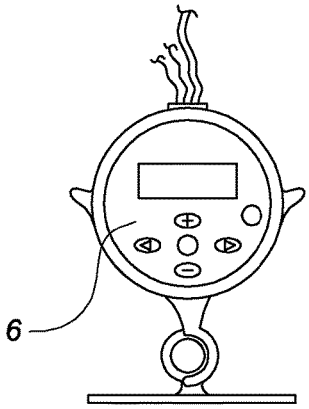
FIG. 2 is an isolated, top view of the controller.
Figure 3:
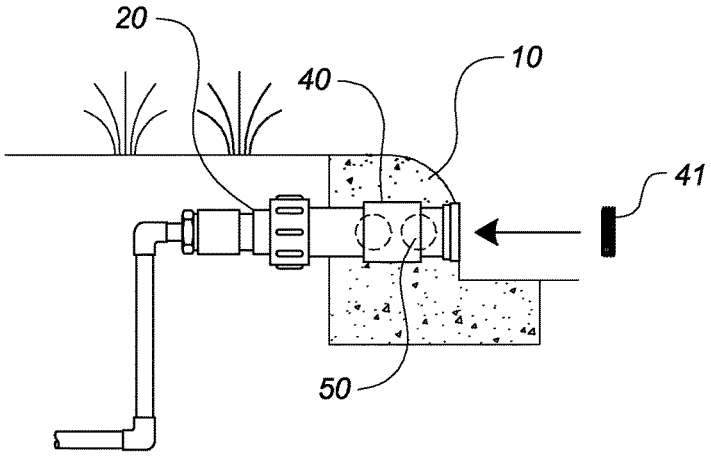
FIG. 3 is an isolated view of the drain-line outlet.
Figure 4:
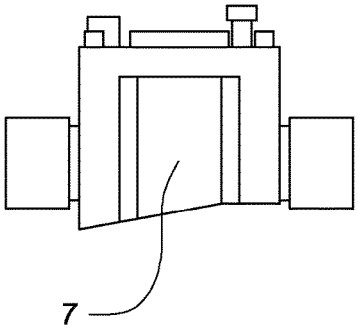
FIG. 4 is an isolated view of the solenoid valve.
Figure 5:
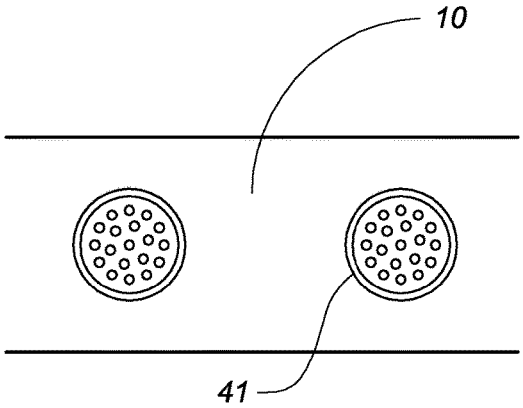
FIG. 5 is an isolated view of the curb exterior and exposed perforated caps.

A flushing system comprises a bleeder tube 1 attached to a pipe fitting 2 installed near the terminus of a dead-end line 3 within a given municipal water artery. The bleeder tube 1 extends to a control box 4 that is buried beneath the ground in a convenient, nearby location. The box 4 includes an open top positioned immediately below ground level with a lid 5 superimposed thereon that provides easy access to a programmable controller 6.

Within the control box and coupled with the bleeder line is a solenoid valve 7 that opens and closes according to a command from the controller 6. The controller can be selectively configured to open the solenoid valve at specific times and for desired durations. A drain line 8 connected to the solenoid valve extends to one or more outlets 20 for delivering water from the dead-end line to a municipal drainage system. Each outlet is connected to a larger-diameter conduit 40 having a perforated, threaded cap 41 removably coupled therewith. The conduit 40 passes through a transverse bore formed in a street curb 10 with the threaded cap being exposed on the exterior surface of the curb.

Accordingly, a user can remove the cap and place dechlorination tablets or a similar material therein so that the effluent quality complies with applicable environmental regulations (i.e., will not kill fish, etc.) before it enters the municipal drainage system. Because the perforated caps are exposed to surface drainage, the bleeder tube includes a double check valve 11 that prevents surface water from back-flowing through the perforated caps and into the municipal water system whenever the solenoid valve 7 is opened and the system pressure decreases.

The control box further includes an electrical temperature probe 12 having a sensor 13 that seats within an opening 14 on the lid for continuously measuring ambient temperatures. The probe 12 is in communication with the controller for disabling the solenoid 7 whenever the ambient temperature is at or below freezing to prevent ice accumulation on the nearby street. Furthermore, a dump valve 30 allows a user to empty the drain line during colder temperatures to prevent freezing.

Accordingly, a user programs the controller to drain the dead-end line at desired intervals and for desired durations. At the programmed interval, the controller opens the solenoid valve to divert water from the dead-end line to the perforated caps on the curb, where it flows into the municipal drainage system.

The above-described device is not limited to the exact details of construction and enumeration of parts provided herein. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a municipal water artery having a dead-end water line, a flushing system comprising:

a bleeder tube connected to said dead-end water line;

a drain line extending to a municipal drainage system;

means for establishing fluid communication between said drain line and said bleeder tube at select intervals and for select durations to drain stagnant water from said dead-end water line.

2. The combination according to claim 1 wherein said means for establishing fluid communication between said drain line and said bleeder tube at select intervals and for select durations comprises:

a solenoid valve connecting said drain line to said bleeder tube;

a controller for opening said solenoid valve at the select intervals and for the select durations.

3. The combination according to claim 1 further comprising:

a conduit at a distal end of said drain line, said conduit terminating at an exposed surface on a street curb;

a perforated cap removably attached to said conduit that allows a user to place a dechlorinating material within said conduit to assure that the stagnant water complies with environmental regulations before entering a municipal drainage system.

4. The combination according to claim 1 further comprising a dump valve connected to said drain line for draining water to the ground to prevent the drain line from freezing.

5. The combination according to claim 2 further comprising a means for disabling said solenoid valve whenever an ambient temperature is below a predetermined threshold.

6. The combination according to claim 5 wherein said means for disabling said solenoid valve whenever the ambient temperature is below the predetermined threshold comprises a temperature sensor in communication with said controller.

7. The combination according to claim 6 wherein said controller, said solenoid valve and said temperature sensor are positioned within a control box buried beneath the ground.

8. In combination with a municipal water artery having a dead-end water line, a flushing system comprising:

a control box buried beneath the ground, said box having an open top positioned immediately below ground level with a lid superimposed thereon;

a bleeder tube connected to said dead-end water line and extending to a solenoid valve within said control box;

a drain line extending from said solenoid to an outlet that is fluid communication with a municipal drainage system;

a controller within said control box for opening said solenoid valve at select intervals and for select durations;

an electrical temperature probe having a sensor that seats within an opening on said lid for continuously measuring ambient temperatures, said probe in communication with said controller for disabling the solenoid whenever the ambient temperature is at or below freezing to prevent ice accumulation on a nearby street.

9. The combination according to claim 8 wherein said outlet is connected to a conduit that passes through a transverse bore formed in a street curb to divert the stagnant water directly a municipal drainage system.

10. The combination according to claim 9 wherein a distal end of said conduit includes a perforated, threaded cap removably coupled therewith, said threaded cap exposed on the exterior surface of the street curb that allows a user to place a dechlorinating material within said conduit to assure that the stagnant water complies with environmental regulations before entering the municipal drainage system.

11. The combination according to claim 10 wherein said bleeder tube includes a double check valve that prevents surface water from back-flowing through the perforated cap and into the municipal water system whenever the solenoid valve is opened and system pressure decreases.

* * * * *